US005614355A

United States Patent [19]

Haye et al.

[11] Patent Number: 5,614,355

[45] Date of Patent: Mar. 25, 1997

[54] PEROXIDE COMPOSITION AND METHOD FOR PROCESSING COLOR PHOTOGRAPHIC ELEMENTS CONTAINING PREDOMINANTLY CHLORIDE SILVER HALIDE EMULSIONS

[75] Inventors: Shirleyanne E. Haye, Rochester; Carl A. Marrese, Penfield; Cheryl W. Bonner, Rochester, all of N.Y.

[73] Assignee: Eastman Kodak Company, Rochester, N.Y.

[21] Appl. No.: 559,588

[22] Filed: Nov. 16, 1995

Related U.S. Application Data

[63] Continuation-in-part of Ser. No. 391,993, Feb. 21, 1995, abandoned.

[51] Int. Cl.[6] ..... G03C 5/44

[52] U.S. Cl. ..... 430/430; 430/461; 430/943

[58] Field of Search ..... 430/393, 430, 430/461, 943

[56] References Cited

U.S. PATENT DOCUMENTS

| | | | |
|---|---|---|---|
| 4,301,236 | 11/1981 | Idota et al. | 430/393 |
| 4,328,306 | 5/1982 | Idota et al. | 430/943 |
| 5,324,624 | 6/1994 | Twist | 430/399 |

FOREIGN PATENT DOCUMENTS

| | | | |
|---|---|---|---|
| 0428101A1 | 5/1991 | European Pat. Off. | G03C 7/42 |
| 92/07300 | 4/1992 | WIPO | G03C 7/44 |
| 93/11459 | 6/1993 | WIPO | G03C 7/042 |

*Primary Examiner*—Hoa Van Le
*Attorney, Agent, or Firm*—J. Lanny Tucker

[57] ABSTRACT

Color photographic elements containing predominantly chloride (greater than or equal to 90 mole %) silver halide emulsions are effectively and rapidly processed using a peroxide bleaching solution which also contains at least 0.45 mol of chloride ion per liter of solution.

16 Claims, No Drawings

PEROXIDE COMPOSITION AND METHOD FOR PROCESSING COLOR PHOTOGRAPHIC ELEMENTS CONTAINING PREDOMINANTLY CHLORIDE SILVER HALIDE EMULSIONS

CROSS REFERENCE TO RELATED APPLICATION

This is a continuation-in-part of application Ser. No. 08/391,993 filed Feb. 21, 1995, abandoned, entitled "Peroxide Composition and Method For Processing Color Photographic Elements Containing Predominantly Chloride Silver Halide Emulsions" by S. Haye, C. Marrese, C. Bonner.

FIELD OF THE INVENTION

The present invention relates generally to the processing of color photographic elements. More particularly, it relates to the use of hydrogen peroxide bleaching solutions comprising a certain amount of chloride ion. The compositions and the methods for their use in photography are the subject of this invention.

BACKGROUND OF THE INVENTION

During processing of silver halide photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions which are more compatible with the environment. Thus it is desirable to reduce or avoid the use of ferric complexes as bleaching agents.

Peracid bleaching solutions, such as those containing peroxide, persulfate, perborate, perphosphate, perhalogen, percarboxylic acid or percarbonate bleaching agents, offer an alternative to the ferric complex bleaching solutions. They are less expensive and present lower chemical and biological demands on the environment since their by-products can be less harmful.

While persulfate bleaching agents have low environmental impact, they have the disadvantage that their bleaching activity is slow and thus require the presence of a bleaching accelerator. The most common bleaching accelerators are thiols that have offensive odors.

Because hydrogen peroxide reacts and decomposes to form water, a hydrogen peroxide based bleaching solution offers many environmental advantages over persulfate and ferric complex bleaching solutions. As a result, many publications describe hydrogen peroxide bleaching solutions, including U.S. Pat. No. 4,277,556 (Koboshi et al), U.S. Pat. No. 4,301,236 (Idota et al), U.S. Pat. No. 4,454,224 (Brien et al), U.S. Pat. No. 4,717,649 (Hall et al) and WO-A-92/01972 (published Feb. 6, 1992).

In addition, WO-A-92/07300 (published Apr. 30, 1992) and EP 0 428 101A1 (published May 22, 1991) describe hydrogen peroxide compositions for bleaching high chloride emulsions (that is, silver halide emulsions having more than 90 mol % silver chloride). These compositions comprise from 0.004 to 0.4 mole of chloride ions per liter of solution and have a pH in the range of 5 to 11. These particular bleaching solutions comprising lower amounts of chloride ion, however, cause vesiculation in the processed elements.

Those having higher amounts of chloride ion, e.g., 0.4 mol/l fail to bleach effectively in short bleaching times.

Despite all of the efforts of researchers in the art, no hydrogen peroxide bleaching composition has been commercialized because of various problems including vesiculation (that is, blistering from evolution of oxygen), poor bleaching efficiency and solution instability.

There remains a need for commercially viable hydrogen peroxide bleaching solutions that are stable and nonvesiculating. Moreover, it would be useful to have such solutions for bleaching photographic elements having predominantly chloride silver halide emulsions.

SUMMARY OF THE INVENTION

The noted problems are solved with a method for processing a color silver halide photographic element comprising:

bleaching an imagewise exposed and developed color silver halide photographic element containing a predominantly silver chloride emulsion with a hydrogen peroxide bleaching solution comprising:

a hydrogen peroxide bleaching agent, and chloride ions present in an amount of at least 0.45 mol/l, provided that the predominantly silver chloride emulsion contains substantially no silver iodide.

The method of this invention provides rapid and efficient bleaching of imagewise exposed and developed color silver halide photographic elements containing predominantly silver chloride emulsions, and substantially no silver iodide in the emulsions. It avoids the problems noted above with known hydrogen peroxide bleaching solutions. No vesiculation is observed with the use of the present invention. Moreover, the bleaching solutions present little environmental harm.

These advantages are achieved by using a hydrogen peroxide bleaching solution which contains at least 0.45 mole of chloride ion per liter of solution. In preferred embodiments, the solution may also contain an organic phosphonic acid or a tertiary aminocarboxylic acid, or a salt thereof to increase stability. The method of this invention is effective with predominantly silver chloride emulsion containing materials (that is, greater than 90 mole % silver chloride in the emulsions).

DETAILED DESCRIPTION OF THE INVENTION

Hydrogen peroxide bleaching solutions of this invention include hydrogen peroxide as the bleaching agent or a compound which releases or generates hydrogen peroxide at alkaline pH. Such hydrogen peroxide precursors are well known in the art, and include for example, perborate, perphosphate, percarbonate, percarboxylate and hydrogen peroxide urea. In addition, hydrogen peroxide can be generated on site by electrolysis of an aqueous solution. Examples of hydrogen peroxide bleaching solutions are described, for example, in *Research Disclosure,* publication 36544, pages 501–541 (September, 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

The amount of hydrogen peroxide (or its precursor) present in the bleaching solution is generally at least 0.15 mol/l and from about 0.15 to about 3 mol/l is preferred.

Chloride ions can be supplied to the bleaching solution as part of a simple inorganic salt, such as an ammonium or alkali metal salt (for example, sodium chloride, potassium chloride, lithium chloride and ammonium chloride). In addition, they can be supplied as organic complexes such as tetraalkylammonium chloride. Preferred salts are sodium chloride and potassium chloride.

Chloride ion concentration is at least 0.45 mol/l with from 0.45 to about 2 mol/l being preferred, and from 0.45 to about 1 mol/l being most preferred.

The bleaching solutions used in this invention are quite simple, having only two essential components, the hydrogen peroxide bleaching agent and chloride ions. Other optional and preferred components include a buffer, and an organic phosphonic acid or a tertiary aminocarboxylic acid, or a salt thereof, both of which are defined below.

The bleaching solution is alkaline, having a pH within the general range of from about 7 to about 13, with a pH of from about 8 to about 12 being preferred, and a more preferred range of from about 9 to about 11. The pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, beta-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium carbonate and potassium carbonate are preferred.

The amount of useful buffer or base would be readily apparent to one skilled in the art.

The bleaching solution of this invention preferably comprises one or more organic phosphonic acids or salts thereof. Generally such compounds are represented by the structure (I):

$$R_1N(CH_2PO_3M_2)_2$$

or (II):

$$R_2R_3C(PO_3M_2)_2$$

wherein $R_1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, beta-phenethyl, o-octamidobenzyl or beta-phenethyl), a substituted or unsubstituted alkylaminoalkyl group (wherein the alkyl portion of the group is as defined above, such as methylaminomethyl or ethylaminoethyl), a substituted or unsubstituted alkoxyalkyl group of 1 to 12 carbon atoms (such as methoxymethyl, methoxyethyl, propoxyethyl, phenoxymethyl, methoxymethylenemethoxymethyl or t-butoxy methyl), a substituted or unsubstituted aryl group having 6 to 10 carbon atoms forming the ring (such as phenyl, naphthyl, 4-methylphenyl, 4-hydroxyphenyl, 3-methoxyphenyl, o-tolyl, m-tolyl or p-carboxyphenyl), a substituted or unsubstituted cycloalkyl group having 5 to 10 carbon atoms forming the ring (such as cyclopentyl, cyclohexyl, cyclooctyl or 4-methylcyclohexyl), or a substituted or unsubstituted heterocyclic group having 5 to 10 atoms forming the ring, wherein one or more atoms are nitrogen, oxygen or sulfur atoms besides carbon atoms [such as pyridyl, pyrimidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino) ethyl].

$R_2$ is hydrogen, a substituted or unsubstituted alkyl group of 1 to 12 carbon atoms (as defined above), a substituted or unsubstituted aryl group having 6 to 10 carbon atoms forming the ring (as defined above), a substituted or unsubstituted cycloalkyl group having 5 to 10 carbon atoms forming the ring (as defined above), a substituted or unsubstituted heterocyclic group having 5 to 10 atoms forming the ring (as defined above), $—PO_3M_2$ or $—CHR_4PO_3M_2$.

$R_3$ is hydrogen, hydroxyl, a substituted or unsubstituted alkyl group of 1 to 12 carbon atoms (defined above) or $—PO_3M_2$.

$R_4$ is hydrogen, hydroxyl, a substituted or unsubstituted alkyl group of 1 to 12 carbon atoms (as defined above) or $—PO_3M_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups above (including the ring structures), useful substituents include, but are not limited to, an alkyl group, hydroxy, sulfo, carbonamido, sulfonamido, sulfamoyl, sulfonato, thialkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_3M_2$, $—CH_2PO_3M_2$ or $—N(CH_2PO_3M_2)_2$, wherein the alkyl (linear or branched) for any of these groups has 1 to 5 carbon atoms.

Representative phosphonic acids useful in the practice of this invention include, but are not limited to the compounds listed in EP 0 428 101A1 (page 4), as well as the following compounds:

ethylenediamine-N,N,N',N'-tetramethylenephosphonic acid,
nitrilo-N,N,N-trimethylenephosphonic acid,
1,2-cyclohexanediamine-N,N,N',N'-tetramethylenephosphonic acid,
o-carboxyaniline-N,N-dimethylenephosphonic acid,
propylamine-N,N-dimethylenephosphonic acid,
4-(N-pyrrolidino)butylamine-N,N-bis(methylenephosphonic acid),
1,3-diamino-2-propanol-N,N,N',N'-tetramethylenephosphonic acid,
1,3-propanediamine-N,N,N',N'-tetramethylenephosphonic acid,
1,6-hexanediamine-N,N,N',N'-tetramethylenephosphonic acid,
o-acetamidobenzylamine-N,N-dimethylenephosphonic acid,
o-toluidine-N,N-dimethylenephosphonic acid,
2-pyridylmethylamine-N,N-dimethylenephosphonic acid,
1-hydroxyethane-1,1-diphosphonic acid,
diethylenetriamine-N,N,N',N'',N''-penta(methylenephosphonic acid),
1-hydroxy-2-phenylethane-1,1-diphosphonic acid,
2-hydroxyethane-1,1-diphosphonic acid,
1-hydroxyethane-1,1,2-triphosphonic acid,
2-hydroxyethane-1,1,2-triphosphonic acid,
ethane-1,1-diphosphonic acid, and
ethane-1,2-diphosphonic acid.

Most useful are 1-hydroxyethylidene-1,1-diphosphonic acid, nitrilo-N,N,N-trimethylenephosphonic acid, diethylenetriamine-N,N,N',N",N"-penta(methylenephosphonic acid) or salts thereof. The first compound is most preferred.

The amount of organic phosphonic acid used in the practice of the invention can be at least about 0.0001 mol/l and generally up to about 0.02 mol/l. An amount of from about 0.0001 to about 0.012 mol/l is preferred.

Instead of, or in addition to, the phosphonic acids (or salts thereof) described above, the bleaching solution of this invention can also contain one or more aminocarboxylic acids (or ammonium or alkali metal salts thereof) that contain a tertiary amine. These compounds can be represented by the structure (III):

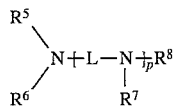

III wherein $R^5$, $R^6$, $R^7$ and $R^8$ are independently hydroxyalkyl of 1 to 3 carbon atoms, or carboxyalkyl of 2 to 4 carbon atoms, provided at least one of these groups is carboxyalkyl. The alkyl groups are substituted and can be linear or branched. The alkyl groups can also be hydroxy-substituted. Preferably, the hydroxyalkyl or carboxyalkyl groups have methyl or ethyl groups.

In structure III, p is 0 or an integer of 1 to 3.

L is a substituted or unsubstituted alkylene group of 2 to 4 carbon atoms (linear or branched, and substituted with hydroxy or carboxy). L can also be a

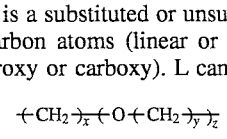

group wherein x and y are independently integers of 2 to 4, and z is an integer of 1 to 3. Moreover, L can be a substituted or unsubstituted cyclic alkylene group having 6 carbon atoms in the ring (optionally substituted with hydroxy or carboxy) or a substituted or unsubstituted arylene group having 6 to 10 carbon atoms in the ring (such as phenylene or naphthylene, optionally substituted with hydroxy or carboxy). Preferably, the compound of Structure III has more than one carboxy group.

Representative tertiary aminocarboxylic acids useful in this invention include, but are not limited to, diethylenetriaminepentaacetic acid and 2-hydroxypropylenediaminetetraacetic acid or salts thereof. The first compound is preferred.

Other addenda commonly added to hydrogen peroxide bleaching solutions can also be included, such as corrosion inhibitors, optical whitening agents, defoaming agents, calcium sequestrants, peroxide stabilizers, radical scavengers, halogen scavengers, and other materials readily apparent to one skilled in the art.

As used herein in defining concentrations of reagents and times, the term "about" refers to ±20% of the indicated amount. In defining pH values, the term "about" refers to ±0.5 unit. In defining temperature, the term "about" refers to ±5° C.

The color photographic elements to be processed using the present invention can contain any of the conventional silver halide emulsions as the photosensitive material as long as the emulsion is predominantly silver chloride. This means that at least 90 mole % of the emulsion is silver chloride. Preferably from 95 to 100 mole % is silver chloride, and most preferably, from 99 to 100 mole % is silver chloride. The remainder of the emulsion is generally silver bromide because the emulsion contains substantially no silver iodide. This means that there is less than 1 mole % silver iodide in the emulsion.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure,* noted above. All types of emulsions can be used in the elements, including but not limited to, thin tabular grain emulsions, and either positive-working or negative-working emulsions. The elements can be either photographic film or paper elements.

The elements processed with this invention can have any desirable level of silver, but preferably, they have silver at a level of less than about 2 g/m$^2$, more preferably at a level of less than about 1 g/m$^2$, and most preferably at a level of less than about 0.80 g/m$^2$. However, this is not intended to limit the practice of this invention since silver chloride elements can have considerably more (e.g., over 2 g/m$^2$) or less (e.g., 0.4 to 0.8 g/m$^2$) than these levels of silver.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Color developers are well known and described in hundreds of publications including the *Research Disclosure,* noted above. In addition to color developing agents, the color developers generally contain a buffer (such as potassium carbonate), a sulfite, chelating agents, halides, and one or more antioxidants as preservatives. There are many classes of useful antioxidants including, but not limited to, hydrazines and substituted or unsubstituted hydroxylamines. By substituted hydroxylamines is meant, for example, those having one or more alkyl or aryl groups connected to the nitrogen atom. These alkyl or aryl groups can be further substituted with one or more groups such as sulfo, carboxy, hydroxy, alkoxy and other groups known in the art which provide solubilizing effects. Examples of such hydroxylamines are described, for example, in U.S. Pat. No. 4,876,174 (Ishikawa et al), U.S. Pat. No. 4,892,804 (Vincent et al), U.S. Pat. No. 5,178,992 (Yoshida et al) and U.S. Pat. No. 5,354,646 (Kobayashi et al). One particularly useful antioxidant, not described in these references, is N-isopropyl-N-ethylsulfonic acid hydroxylamine, and salts thereof.

Development can also be carried out using what is known in the art as a "developer/amplifier" solution, as described in U.S. Pat. No. 5,324,624 (Twist).

Development can then be followed by the use of a hydrogen peroxide bleaching solution according to the practice of this invention. The bleaching step can be carried out in any suitable fashion, as is known in the art. Color prints and films can be processed using a wide variety of processing protocols, as described for example, in *Research Disclosure,* noted above, and thus can include various combinations of one or more bleaching, fixing, washing or stabilizing steps in various orders, and lastly, drying. Additionally, reversal processes include additional steps of black and white development, chemical fogging, re-exposure, and washing prior to color development.

For the purpose of minimizing any further reaction of oxidized color developing agent with dye-forming compounds in the photographic element during bleaching, it is highly preferred that one or more additional treatments be performed between color development and bleaching as described above. Among such treatments are contacting the element with an acidic processing solution (such as dilute sulfuric or acetic acid stop bath solutions or buffer solutions, with a pH preferably of from about 1 to about 7); contacting the element with a water wash bath (or rinse) having a pH ranging from about 3 to about 7; or wiping the photographic element with squeegee or other device that minimizes the amount of processing solution that is carried by the photographic element from one processing solution to another. Most preferably, an acidic stop bath is used between color development and peroxide bleaching.

Bleaching is generally carried out for less than about 60 seconds, but longer times can be used if desired. Preferably, the bleaching time is less than about 45 seconds, and more preferably, it is less than about 30 seconds. Bleaching is generally carried out at a temperature that is at or above room temperature, for example from about 25 to about 50° C., and more preferably from about 30 to about 40° C.

Processing according to the present invention can be carried out using conventional processing equipment. Alternatively, it can be carried out using what is known in the art as "low volume thin tank" processing systems having either rack or tank or automatic tray designs. Such processing methods and equipment are described, for example, in U.S. Pat. No. 5,436,118 (Carli et al) and publications noted therein.

The bleaching solution of this invention can also include a color developing agent and be used as what are known in the art as developer/amplifier solutions in processes which are described in numerous publications, including U.S. Pat. No. 5,324,624 (Twist).

The following examples are presented to illustrate the practice of this invention, and are not intended to be limiting in any way. Unless otherwise indicated, all percentages are by weight.

Example 1

Bleaching Of Photographic Paper Containing Chloride Emulsion

Samples of EKTACOLOR EDGE™ Color Paper (containing more than 90 mole % chloride emulsions) were exposed 1/10 second to a step wedge test object using HA-50 and NP-11 filers, a 0.3 Inconel and 3000K illumination on a conventional 1B sensitometer, and processed using the following protocol (all steps under nitrogen). The bleaching time was varied to determine bleaching effectiveness.

| | | |
|---|---|---|
| 45 seconds | 35° C. | Development* |
| 30 seconds | 35° C. | Stop solution (1% v/v $H_2SO_4$) |
| 30 seconds | 33.3° C. | Water wash |
| 0–2 minutes | 35° C. | Bleaching |
| 30 seconds | 33.3° C. | Water wash |
| 1 minutes | 35° C. | Fixing** |
| 2 minutes | 33.3° C. | Water wash |

*The developing solution (per liter) was the conventional KODAK EKTACOLOR ™ RA Color Developer.

**The fixing solution (per liter) was an aqueous solution of sodium metabisulfite (11.8 g) and a solution (162 ml) of ammonium thiosulfate (56.5%) and ammonium sulfite (4%), and had a pH of 6.5.

The Example 1 bleaching solution contained hydrogen peroxide (0.98 mol/l, 3% w/w), sodium chloride (0.35 mol/l), potassium carbonate (0.036 mol/l) and potassium bicarbonate (0.064 mol/l), and was adjusted to pH 10 with sodium hydroxide.

A Control A bleaching solution was a conventional KODAK EKTACOLOR™ RA bleach-fixing solution containing (per liter) ferric ethylenedinitrilotetraacetate bleaching agent (50 g), ammonium thiosulfate (58%, 80 ml), sodium sulfite (7.5 g), glacial acetic acid (5 ml) and silver (3 g), and having a pH of 6.2.

A Control B bleaching solution contained hydrogen peroxide (0.98 mol/l, 3% w/w) only and was adjusted to pH 10 with potassium hydroxide.

A Control C bleaching solution contained hydrogen peroxide (0.98 mol/l, 3% w/w), potassium carbonate (0.036 mol/l) and potassium bicarbonate (0.064 mol/l) and was adjusted to pH 10 with potassium hydroxide.

Residual silver ($g/m^2$) at maximum density was determined by X-ray fluorescence using conventional procedures. The results are tabulated below in Table I. Bleaching was considered complete when the residual silver level was less than 0.05 $g/m^2$.

TABLE I

| Bleaching Time (seconds) | Example 1 ($g/m^2$) | Control A ($g/m^2$) | Control B ($g/m^2$) | Control C ($g/m^2$) |
|---|---|---|---|---|
| 0 | 0.73 | 0.72 | 0.75 | 0.73 |
| 15 | 0.01 | 0.07 | 0.60 | 0.62 |
| 30 | 0 | 0.04 | 0.69 | 0.67 |
| 60 | 0 | 0.04 | 0.65 | 0.69 |
| 120 | 0 | 0.04 | 0.69 | 0.67 |

The data in Table I show that practice of the present invention rapidly and effectively bleached the photographic element, and was comparable to the conventional bleaching (Control A). The Control B and C solutions failed to satisfactorily bleach the element even after two minutes of bleaching time. No vesiculation was observed with the practice of this invention.

Examples 2–3

Processing Of Color Paper With & Without Phosphonic Acid

Two bleaching solutions were compared to a bleaching solution taught in WO-A-92/07300 (noted above), identified herein as Control D, in processing samples of EKTACOLOR EDGE™ Color Paper. The samples were exposed and processed using the protocol described in Example 1.

The Example 2 bleaching solution contained hydrogen peroxide (0.98 mol/l, 3% w/w), potassium chloride (0.5 mol/l), 1-hydroxyethylidene-1,1-diphosphonic acid (0.004 mol/l), potassium carbonate (0.058 mol/l) and potassium bicarbonate (0.122 mol/l), and was adjusted to pH 10 with potassium hydroxide.

The Example 3 bleaching solution was similar to Example 2 bleaching solution except that the diphosphonic acid was omitted.

The Control D bleaching solution contained hydrogen peroxide (0.98 mol/l, 3% w/w), potassium chloride (0.067 mol/l) and potassium carbonate (0.18 mol/l), and was adjusted to pH 10 with potassium hydroxide.

Residual silver (g/m$^2$) was measured after 45 seconds of bleaching by X-ray fluorescence using conventional procedures. The resulting data at several exposure levels are tabulated in Table II below. Bleaching was considered complete when the residual silver level was less than 0.05 g/m$^2$.

TABLE II

| Exposure Step Number | Example 2 (g/m$^2$) | Example 3 (g/m$^2$) | Control D (g/m$^2$) |
|---|---|---|---|
| 1 | 0.02 | 0.01 | 0.02 |
| 3 | 0.03 | 0.01 | 0.01 |
| 5 | 0.01 | 0.01 | 0.01 |
| 7 | 0.01 | 0 | 0.03 |
| 9 | 0.01 | 0.01 | 0.01 |
| 11 | 0 | 0 | 0.02 |
| 13 | 0 | 0 | 0.01 |
| 15 | 0.01 | 0 | 0.01 |
| 17 | 0 | 0 | 0 |
| 19 | 0.01 | 0 | 0.02 |
| 21 | 0 | 0 | 0.01 |

The data in Table II show all three bleaching solutions were effective to bleach the elements within 45 seconds. However, vesiculation was observed using the Control D prior art solution. No vesiculation was observed when the present invention was practiced.

Example 4

Processing with Low Amounts of Peroxide

The present invention was used to process samples of EKTACOLOR EDGE™ Color Paper as described above in Example 1, except that the amount of hydrogen peroxide bleaching agent was lowered to 0.49 mol/l.

The Example 4 bleaching solution contained hydrogen peroxide (0.49 mol/l, 1.5% w/w), sodium chloride (0.5 mol/l), 1-hydroxyethylidene-1,1-diphosphonic acid (0.004 mol/l), potassium carbonate (0.025 mol/l) and potassium bicarbonate (0.025 mol/l), and was adjusted to pH 10 with sodium hydroxide.

A Control E bleaching solution was prepared as taught in EP 0 428 101A1 (noted above), containing hydrogen peroxide (0.49 mol/l, 1.5% w/w), sodium chloride (0.035 mol/l), 1-hydroxyethylidene-1,1-diphosphonic acid (0.005 mol/l), potassium carbonate (0.015 mol/l) and potassium bicarbonate (0.06 mol/l), and was adjusted to pH 10 with sodium hydroxide.

Residual silver was measured after 45 seconds using X-ray fluorescence and conventional procedures. The results are tabulated below in Table III for various exposure densities. Bleaching was considered complete when the residual silver level was less than 0.05 g/m$^2$.

TABLE III

| Step Number | Example 4 (g/m$^2$) | Control E (g/m$^2$) |
|---|---|---|
| 1 | 0.02. | 0.02 |
| 3 | 0 | 0 |
| 5 | 0.02 | 0.02 |
| 7 | 0.03 | 0.03 |
| 9 | 0.01 | 0.02 |
| 11 | 0.02 | 0.03 |
| 13 | 0 | 0 |
| 15 | 0 | 0.01 |
| 17 | 0.03 | 0.01 |
| 19 | 0.01 | 0.01 |
| 21 | 0 | 0 |

These data show that both bleaching solutions were effective within 45 seconds bleaching time. However, vesiculation was observed with the Control E solution. None was observed with the present invention.

Example 5

Processing With Higher Chloride Ion Levels

The present invention was used to process samples of KODAK EKTACOLOR EDGE™ Color Paper which were exposed and processed using the protocol described in Example 1.

The Example 5 bleaching solution contained hydrogen peroxide (0.98 mol/l, 3%), sodium chloride (0.5 mol/l) and potassium carbonate buffer (0.05 mol/l), and was adjusted to pH of 10 with sodium hydroxide.

In addition, different samples of the same photographic element were similarly processed using the Control A bleaching solution described above.

Residual silver (g/m$^2$) at maximum density was determined by X-ray fluorescence using conventional procedures. The results are tabulated below in Table IV. Bleaching was considered complete when the residual silver level was less than 0.05 g/m$^2$.

TABLE IV

| Bleaching Time (sec) | Example 5 (g/m$^2$) | Control A (g/m$^2$) |
|---|---|---|
| 0 | 0.75 | 0.75 |
| 15 | 0.02 | 0.07 |
| 30 | 0.02 | 0.04 |
| 45 | 0.01 | 0.04 |
| 60 | 0.01 | 0.03 |
| 120 | 0.00 | 0.02 |

These data clearly show that the use of the present invention, wherein the hydrogen peroxide bleaching solution contains at least 0.45 mole of chloride ion per liter of solution rapidly (less than 15 seconds) and effectively bleached the photographic paper (less than 0.02 g Ag/m$^2$). The Control A solution, a conventional ferric complex bleach-fixing solution was not quite as rapid or effective.

The method described in this example should also be compared to the use of chloride ion at only 0.4 mol/l as described in EP-A-0 428 101A (page 51, runs 8 and 9). In "Run 8", the art shows that hydrogen peroxide bleaching of the high silver chloride paper after 15 seconds left 0.04 g residual silver per m$^2$. This is more than twice the amount of residual silver left using the present invention. In other words, at the rapid bleaching time of 15 seconds, the present invention (>0.45 g Cl–/l) was more effective than the process described in the reference (0.4 g Cl–/l).

It can also be seen from "Run 9" in the reference that it required 50 seconds bleaching time to reduce the residual silver to 0.01 g/m. However, if the bleaching time is increased, the Dmin values were undesirably increased. Hence, the reference has teaching directed to decreasing the bleaching time, but in doing so, bleaching is incomplete. The present invention has solved that problem by increasing chloride ion level beyond that suggested in the reference.

The invention has been described in detail with particular reference to preferred embodiments thereof, but it will be understood that variations and modifications can be effected within the spirit and scope of the invention.

We claim:

1. A method for processing a color silver halide photographic element comprising:

bleaching an imagewise exposed and developed color silver halide photographic element containing a predominantly silver chloride emulsion having from 95 to 100 mol % silver chloride, less than 1 mol % silver iodide, and a silver level of less than about 1 g silver per $m^2$, with a hydrogen peroxide bleaching solution having a pH of from about 7 to about 13, and comprising:

a hydrogen peroxide bleaching agent in an amount of at least about 0.15 mol/l, and chloride ions present in an amount of from 0.45 to about 2 mol/l.

2. The method of claim 1 wherein said hydrogen peroxide is provided by a hydrogen peroxide precursor.

3. The method of claim 1 wherein said bleaching solution comprises chloride ions in an amount of from 0.45 to 1 mol/l.

4. The method of claim 1 wherein said bleaching solution comprises:

an organic phosphonic acid or salt thereof having the structure (I):

$$R_1N(CH_2PO_3M_2)_2$$

or the structure (II):

$$R_2R_3C(PO_3M_2)_2$$

wherein $R_1$ is hydrogen, an alkyl group of 1 to 12 carbon atoms, an alkylaminoalkyl group wherein each alkyl group has 1 to 12 carbon atoms, an alkoxyalkyl group of 1 to 12 carbon atoms, an aryl group of 6 to 10 carbon atoms, a cycloalkyl group of 5 to 10 carbon atoms in the ring, or a heterocyclic group having 5 to 10 atoms in the ring, $R_2$ is hydrogen, an alkyl group of 1 to 12 carbon atoms, an aryl group of 6 to 10 carbon atoms in the ring, a cycloalkyl group of 5 to 10 carbon atoms in the ring, a heterocyclic group having 5 to 10 atoms in the ring, $—PO_3M_2$, or $—CHR_4PO_3M_2$, $R_3$ is hydrogen, hydroxyl, an alkyl group of 1 to 12 carbon atoms or $—PO_3M_2$, $R_4$ is hydrogen, hydroxyl, an alkyl group of 1 to 12 carbon atoms or $—PO_3M_2$, and M is hydrogen or a water-soluble monovalent cation; or a tertiary aminocarboxylic acid having the structure (III)

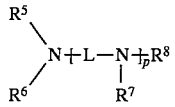

III wherein $R^5$, $R^6$, $R^7$ and $R^8$ are independently a hydroxyalkyl group or a carboxyalkyl group, provided at least one of them is a carboxyalkyl group, p is 0, 1, 2 or 3, L is an alkylene group, a $$\left(CH_2\right)_x\left(O\left(CH_2\right)_y\right)_z$$

group, a cyclic alkylene group having 6 carbon atoms in the ring or an arylene group having 6 to 10 carbon atoms in the ring, x and y are independently integers of 2 to 4, and z is an integer of 1 to 3, or a salt of said tertiary aminocarboxylic acid.

5. The method of claim 4 wherein said organic phosphonic acid or salt thereof is 1-hydroxyethylidene-1,1-diphosphonic acid, nitrilo-N,N,N-trimethylenephosphonic acid or diethylenetriamine-N,N,N',N",N"-penta(methylenephosphonic acid), and said tertiary aminocarboxylic acid is diethylenetriaminepentaacetic acid or 2-hydroxypropylenediaminetetraacetic acid.

6. The method of claim 4 wherein said organic phosphonic acid, tertiary aminocarboxylic acid, or salt thereof is present in said bleaching solution in an amount of from about 0.0001 to about 0.02 mol/l.

7. The method of claim 6 wherein said organic phosphonic acid, tertiary aminocarboxylic acid, or salt thereof is present in said bleaching solution in an amount of from about 0.0001 to about 0.012 mol/l.

8. The method of claim 1 wherein hydrogen peroxide is present in said bleaching solution in an amount of from about 0.15 to about 3 mol/l.

9. The method of claim 1 wherein said bleaching is completed within about 45 seconds.

10. The method of claim 1 wherein said predominantly silver chloride emulsion is a silver chlorobromide, silver chloride or silver chlorobromoiodide emulsion.

11. The method of claim 10 wherein said predominantly silver chloride emulsion is 100 mol % silver chloride.

12. The method of claim 1 wherein said photographic element comprises a silver level of from about 0.4 to about 0.8 g of silver per $m^2$.

13. The method of claim 1 wherein prior to said bleaching step, treating said imagewise exposed and developed color silver halide photographic element with an acidic processing solution, or wiping said imagewise exposed and developed color silver halide photographic element to minimize processing solution carryover.

14. The method of claim 13 wherein said imagewise exposed and developed color silver halide photographic element is treated with an acidic processing solution.

15. The method of claim 14 wherein said acidic processing solution is an acidic stop bath comprising acetic or sulfuric acid.

16. The method of claim 1 wherein said bleaching is completed within about 30 seconds.

* * * * *